US010867549B2

(12) United States Patent
Xuan

(10) Patent No.: US 10,867,549 B2
(45) Date of Patent: Dec. 15, 2020

(54) COMPENSATION METHOD OF PIXEL CIRCUIT IN ORGANIC LIGHT-EMITTING DIODE DISPLAY PANEL AND RELATED DEVICES

(71) Applicant: BOE Technology Group Co., Ltd., Beijing (CN)

(72) Inventor: Minghua Xuan, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 167 days.

(21) Appl. No.: 16/068,961

(22) PCT Filed: Jan. 5, 2018

(86) PCT No.: PCT/CN2018/071497
§ 371 (c)(1),
(2) Date: Jul. 10, 2018

(87) PCT Pub. No.: WO2018/223694
PCT Pub. Date: Dec. 13, 2018

(65) Prior Publication Data

US 2020/0152119 A1 May 14, 2020

(30) Foreign Application Priority Data

Jun. 7, 2017 (CN) ..... 2017 1 0421635

(51) Int. Cl.
*G09G 3/3208* (2016.01)

(52) U.S. Cl.
CPC ... *G09G 3/3208* (2013.01); *G09G 2320/0209* (2013.01)

(58) Field of Classification Search
CPC ..... G09G 3/3208; G09G 2320/0209
See application file for complete search history.

(56) References Cited

U.S. PATENT DOCUMENTS

2006/0028408 A1 2/2006 Kim
2006/0108937 A1* 5/2006 Kim ..... G09G 3/3233 315/169.3

(Continued)

FOREIGN PATENT DOCUMENTS

CN 1716370 A 1/2006
CN 1773594 A 5/2006

(Continued)

OTHER PUBLICATIONS

International Search Report for PCT/CN20181/071497 dated Apr. 4, 2018.
Chinese Office Action for CN201710421635.2 dated Dec. 10, 2018.

*Primary Examiner* — Chun-Nan Lin
(74) *Attorney, Agent, or Firm* — Arent Fox LLP; Michael Fainberg

(57) ABSTRACT

The disclosure discloses a compensation method and device of an organic light-emitting diode display panel, and an organic light-emitting diode display device. A high-voltage signal received at a first electrode of a driver transistor in the pixel circuit is detected when a light-emitting element in the pixel circuit is emitting light in the current frame. Then the voltage difference between the high-voltage signals received by the driver transistor in the current frame and a preceding frame, i.e., compensation voltage, is determined according to the detected high-voltage signal received by the pixel circuit in the current frame, and the pre-stored high-voltage signal received by the pixel circuit in the preceding frame. When the compensation voltage lies out of a preset range, voltage compensation is performed on a reference voltage signal applied to the pixel circuit according to the compensation voltage.

4 Claims, 5 Drawing Sheets

(56) References Cited

U.S. PATENT DOCUMENTS

| | | | | |
|---|---|---|---|---|
| 2012/0086694 | A1* | 4/2012 | Tseng | G09G 3/3233 345/212 |
| 2012/0242712 | A1 | 9/2012 | Ko et al. | |
| 2013/0127932 | A1 | 5/2013 | Han | |
| 2014/0162124 | A1 | 6/2014 | Watanabe et al. | |
| 2014/0168039 | A1* | 6/2014 | Kim | G09G 3/3208 345/82 |
| 2014/0192038 | A1 | 7/2014 | Qin et al. | |
| 2015/0130859 | A1* | 5/2015 | Yang | G09G 3/3233 345/690 |
| 2016/0180775 | A1 | 6/2016 | Kim | |
| 2016/0343304 | A1 | 11/2016 | Hwang et al. | |

FOREIGN PATENT DOCUMENTS

| | | | |
|---|---|---|---|
| CN | 104464621 | A | 3/2013 |
| CN | 103077680 | A | 5/2013 |
| CN | 106782321 | A | 5/2014 |
| CN | 104537985 | A | 4/2015 |
| CN | 104751771 | A | 7/2015 |
| CN | 105096831 | A | 11/2015 |
| CN | 105931600 | A | 9/2016 |
| CN | 107103879 | A | 8/2017 |
| TW | 201216244 | A | 4/2012 |

* cited by examiner

COMPENSATION METHOD OF PIXEL CIRCUIT IN ORGANIC LIGHT-EMITTING DIODE DISPLAY PANEL AND RELATED DEVICES

This application is a National Stage of International Application No. PCT/CN2018/071497, filed Jan. 5, 2018, which claims priority to Chinese Patent Application No. 201710421635.2, filed with the Chinese Patent Office on Jun. 7, 2017, and entitled "Compensation method and device of organic light-emitting diode display panel", the content of which is hereby incorporated by reference in its entirety.

FIELD

The present application relates to the field of communications, and particularly to a compensation method and device of an organic light-emitting diode display panel, and an organic light-emitting diode display device.

BACKGROUND

An Organic Light-Emitting Diode (OLED) display is one of focuses in the existing research field of flat panel displays, and the OLED display has the advantages of a rapid response, high brightness, high contrast, low power consumption, easiness to be a flexible display, etc., over a Liquid Crystal Display (LCD), and is regarded as the predominant next generation of display. Unlike the LCD in which brightness is controlled using stable voltage, the OLED display is current-driven display, which is controlled using stable current to emit light. At present, it is common in the OLED display to write a data signal Vdata into a gate of a driver transistor in a pixel circuit, and to input a high-voltage signal VDD into a source of the driver transistor, so that the driver transistor generates current under the action of gate-source voltage to drive an OLED connected therewith to emit light. While two adjacent frames of images are varying, the driver transistor in the pixel circuit receives the constant high-voltage signal VDD under the ideal condition, but there is an IR drop in the OLED display, and the current flowing through the driver transistor is varying while the two adjacent frames of images are varying, so that the voltage of the high-voltage signal VDD received at the source of the driver transistor may vary between the two adjacent frames of images, and the voltage of the high-voltage signal VDD may vary more distinctly while there is a serious IR drop, thus resulting in crosstalk between the images, and deteriorating a display effect of the images, while a user is touching on the dynamic images.

SUMMARY

Embodiments of the disclosure provide a compensation method and device of an organic light-emitting diode display panel, and an organic light-emitting diode display device.

An embodiment of the disclosure provides a compensation method of an organic light-emitting diode display panel, including: detecting a high-voltage signal received at a first electrode of a driver transistor in a pixel circuit in the organic light-emitting diode display panel in a current frame when a light-emitting element in the pixel circuit is emitting light; determining compensation voltage corresponding to the pixel circuit according to the detected high-voltage signal received by the pixel circuit in the current frame, and a pre-stored high-voltage signal received by the pixel circuit in a preceding frame, wherein the compensation voltage is the voltage difference between the high-voltage signal received in the current frame, and the high-voltage signal received in the preceding frame; and performing voltage compensation on a reference voltage signal applied to the corresponding pixel circuit according to the compensation voltage when the compensation voltage lies out of a preset range.

Optionally in the compensation method according to the embodiment of the disclosure, a plurality of pixel circuits are arranged in a display area of the organic light-emitting display panel, and the method includes: detecting the high-voltage signal received at the first electrode of the driver transistor in each of the plurality of pixel circuits in the organic light-emitting diode display panel in the current frame when the light-emitting element in each of the pixel circuits is emitting light; determining compensation voltage corresponding to each of the pixel circuits according to the detected high-voltage signal received by each of the pixel circuits in the current frame, and the pre-stored high-voltage signal received by each of the pixel circuits in the preceding frame, wherein the compensation voltage is the voltage difference between a high-voltage signal received by a corresponding pixel circuit in the current frame, and a high-voltage signal received by the corresponding pixel circuit in the preceding frame; and performing, for each of the pixel circuits, voltage compensation on a reference voltage signal applied to the corresponding pixel circuit according to the compensation voltage corresponding to the pixel circuit when the compensation voltage lies out of a preset range.

Optionally in the compensation method according to the embodiment of the disclosure, a display area of the organic light-emitting display panel includes a plurality of display sub-areas, and at least one pixel circuit is arranged in each of the display sub-areas; and before the high-voltage signal received at the first electrode of the driver transistor in the pixel circuit in the current frame is detected, the method further includes: determining an IR drop corresponding to each of the display sub-areas, and for each of the display sub-areas, when the IR drop corresponding to the display sub-area lies out of a preset drop range, determining the display sub-area corresponding to the IR drop lying out of the preset drop range as a display sub-area to be compensated; and the detecting the high-voltage signal received at the first electrode of the driver transistor in the pixel circuit in the organic light-emitting diode display panel in the current frame when the light-emitting element in the pixel circuit is emitting light includes: detecting the high-voltage signal received at the first electrode of the driver transistor in each of the at least one pixel circuit in the display sub-area to be compensated, in the current frame when the light-emitting element in each of the at least one pixel circuit in the display sub-area to be compensated are emitting light.

Optionally in the compensation method according to the embodiment of the disclosure, the plurality of display sub-areas are of the same area size.

Optionally in the compensation method according to the embodiment of the disclosure, one pixel circuit is arranged in each of the display sub-areas.

Optionally in the compensation method according to the embodiment of the disclosure, the performing voltage compensation on the reference voltage signal applied to the corresponding pixel circuit according to the compensation voltage includes: applying the reference voltage signal, to which the compensation voltage is added, to the corresponding pixel circuit.

Optionally in the compensation method according to the embodiment of the disclosure, after the high-voltage signal received at the first electrode of the driver transistor in the pixel circuit in the current frame is detected, and before the compensation voltage corresponding to the pixel circuit is determined, the method further includes: storing the detected high-voltage signal received at the first electrode of the driver transistor in the pixel circuit in the current frame.

Correspondingly an embodiment of the disclosure further provides a compensation device of an organic light-emitting diode display panel, including: a detecting unit configured to detect a high-voltage signal received at a first electrode of a driver transistor in a pixel circuit in the organic light-emitting diode display panel in a current frame when a light-emitting element in the pixel circuit is emitting light; a storing unit configured to store a detected high-voltage signal received at the first electrode of the driver transistor in the pixel circuit in a preceding frame; a compensation voltage determining unit configured to determine compensation voltage corresponding to the pixel circuit according to the detected high-voltage signal received by the pixel circuit in the current frame, and the pre-stored high-voltage signal received by the pixel circuit in the preceding frame, wherein the compensation voltage is the voltage difference between the high-voltage signal received in the current frame, and the high-voltage signal received in the preceding frame; and a compensating unit configured to perform voltage compensation on a reference voltage signal applied to the corresponding pixel circuit according to the compensation voltage when the compensation voltage lies out of a preset range.

Optionally in the compensation device according to the embodiment of the disclosure, a plurality of pixel circuits are arranged in a display area of the organic light-emitting display panel; the detecting unit is configured to detect the high-voltage signal received at the first electrode of the driver transistor in each of the plurality of pixel circuits in the organic light-emitting diode display panel in the current frame when the light-emitting element in each of the pixel circuits is emitting light; the compensation voltage determining unit is configured to determine the compensation voltage corresponding to each of the pixel circuits according to the detected high-voltage signal received by each of the pixel circuits in the current frame, and pre-stored high-voltage signal received by each of the pixel circuits in the preceding frame, wherein the compensation voltage is the voltage difference between a high-voltage signal received by a corresponding pixel circuit in the current frame, and a high-voltage signal received by the corresponding pixel circuit in the preceding frame; and the compensating unit is configured to perform, for each of the pixel circuits, voltage compensation on a reference voltage signal applied to the corresponding pixel circuit according to the compensation voltage corresponding to the pixel circuit when the compensation voltage lies out of a preset range.

Optionally in the compensation device according to the embodiment of the disclosure, a display area of the organic light-emitting display panel includes a plurality of display sub-areas, and at least one pixel circuit is arranged in each of the display sub-areas; and the compensation device further includes: a drop determining unit configured to determine an IR drop corresponding to each of the display sub-areas, an area determining unit configured, for each of the display sub-areas, when the IR drop corresponding to the display sub-area lies out of a preset drop range, to determine the display sub-area corresponding to the IR drop lying out of the preset drop range as a display sub-area to be compensated; and the detecting unit is configured to detect the high-voltage signal received at the first electrode of the driver transistor in each of the at least one pixel circuit in the display sub-area to be compensated, in the current frame when the light-emitting element in each of the at least one pixel circuit in the display sub-area to be compensated is emitting light.

Optionally in the compensation device according to the embodiment of the disclosure, the plurality of display sub-areas are of the same area size.

Optionally in the compensation device according to the embodiment of the disclosure, one pixel circuit is arranged in each of the display sub-areas.

Optionally in the compensation device according to the embodiment of the disclosure, the compensating unit is configured to apply the reference voltage signal, to which the compensation voltage is added, to the corresponding pixel circuit.

Optionally in the compensation device according to the embodiment of the disclosure, the storing unit is further configured to store the detected high-voltage signal received at the first electrode of the driver transistor in the pixel circuit in the current frame.

Correspondingly an embodiment of this disclosure further provides an organic light-emitting display device including an organic light-emitting display panel including a plurality of pixel circuits arranged in an array, wherein the organic light-emitting display device further includes the compensation device according to any one of the embodiments above of this disclosure.

DETAILED DESCRIPTION

In order to make the objects, technical solutions, and advantages of the disclosure more apparent, particular implementations of the compensation method and device of an organic light-emitting diode display panel, and the organic light-emitting diode display device according to the embodiments of the disclosure will be described below in details with reference to the drawings. It shall be appreciated that the preferable embodiments to be described below are merely intended to illustrate and explain the disclosure, but not to limit the disclosure thereto, and the embodiments of the disclosure, and the features in the embodiments can be combined with each other unless they conflict with each other.

Figure 1:
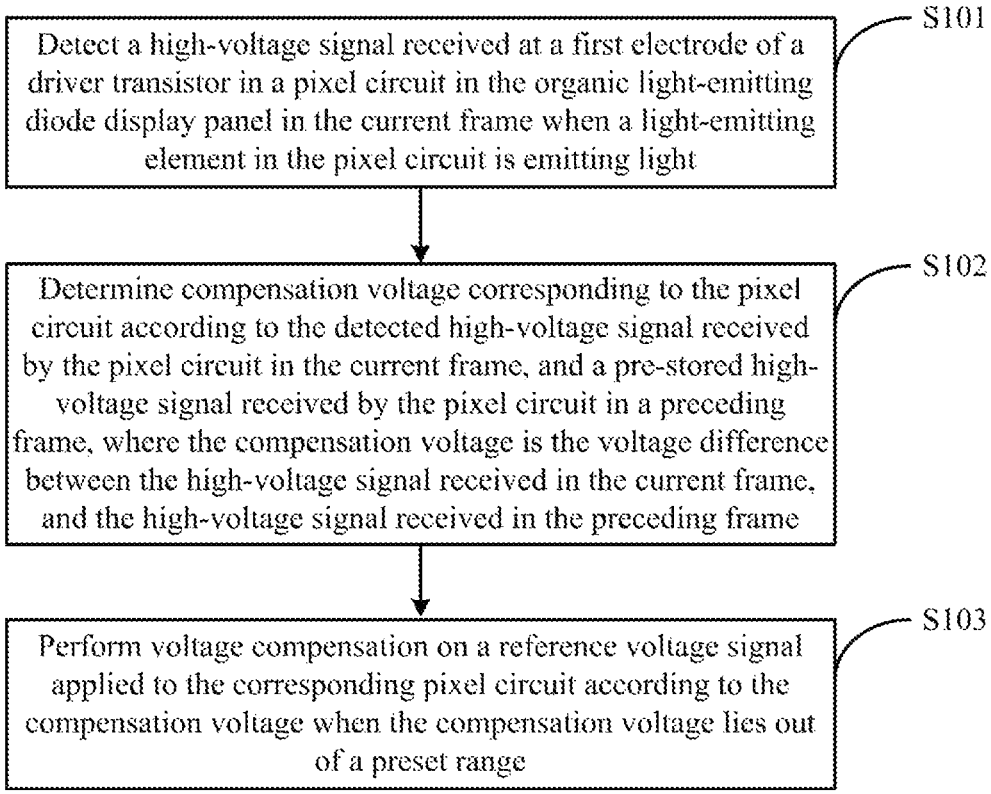
FIG. 1 is a flow chart of a compensation method of an organic light-emitting diode display panel according to an embodiment of the disclosure.

An embodiment of the disclosure provides a compensation method of an organic light-emitting diode display panel, and as illustrate in FIG. 1, the method includes the following steps.

The step S101 is to detect a high-voltage signal received at a first electrode of a driver transistor in a pixel circuit in the organic light-emitting diode display panel in the current frame when a light-emitting element in the pixel circuit is emitting light.

The step S102 is to determine compensation voltage corresponding to the pixel circuit according to the detected high-voltage signal received by the pixel circuit in the current frame, and a pre-stored high-voltage signal received by the pixel circuit in a preceding frame, where the compensation voltage is the voltage difference between the high-voltage signal received in the current frame, and the high-voltage signal received in the preceding frame.

The step S103 is to perform voltage compensation on a reference voltage signal applied to the corresponding pixel circuit according to the compensation voltage when the compensation voltage lies out of a preset range.

In the compensation method above of the organic light-emitting diode display panel according to the embodiment of the disclosure, a high-voltage signal received at the first electrode of the driver transistor in the pixel circuit is detected when the light-emitting element in the pixel circuit is emitting light in the current frame, where the high-voltage signal is a signal used by the driver transistor to generate current in the current frame to drive the light-emitting element connected with the driver transistor to emit light. Then the voltage difference between the high-voltage signal received by the driver transistor in the current frame, and the high-voltage signal received by the driver transistor in the preceding frame, i.e., compensation voltage, is determined according to the detected high-voltage signal received by the pixel circuit in the current frame, and the pre-stored high-voltage signal received by the pixel circuit in the preceding frame. Voltage compensation is performed on a reference voltage signal applied to the pixel circuit according to the compensation voltage when the compensation voltage lies out of a preset range, so that the problem of crosstalk between moving images when a user is touching on the images can be alleviated to thereby improve a display effect of the images.

Specifically in the compensation method according to the embodiment of the disclosure, when the voltage of the high-voltage signal received in the current frame is higher than the voltage of the high-voltage signal received in the preceding frame, the compensation voltage is positive voltage; and when the voltage of the high-voltage signal received in the current frame is lower than the voltage of the high-voltage signal received in the preceding frame, the compensation voltage is negative voltage.

In the compensation method according to the embodiment of the disclosure, the first electrode of the driver transistor is configured to receive the high-voltage signal, and a second electrode of the driver transistor is connected with the corresponding light-emitting element. The driver transistor may be a P-type transistor, or may be an N-type transistor, and the first electrode may be a source or a drain of the driver transistor, and second electrode may be the drain or the source of the driver transistor, dependent upon a different type of the driver transistor; and this shall be designed for a real application environment, although the embodiment of the disclosure will not be limited thereto.

In a real application, even if two adjacent frames of displayed images are the same, then the high-voltage signal received at the first electrode of the driver transistor generally cannot remain exactly uniform due to a process, aging of components, etc., thereof, so when the difference between the high-voltage signals received at the first electrode of the driver transistor in the two adjacent frames lies into an allowable error range, they can be regarded as being substantially equal.

Accordingly optionally in the compensation method according to the embodiment of the disclosure, the preset range is an allowable error range which is derived empirically. For example, the preset range can be −0.100V to 0.100V, or −0.01V to 0.01V, or −0.001V to 0.001V. Of course, the allowable error range above is different as required for the organic light-emitting display panel with a different function, so the preset range shall be designed for a real application environment, although the embodiment of the disclosure will not be limited thereto.

Optionally in the compensation method according to the embodiment of the disclosure, the light-emitting element is generally an organic light-emitting diode, which emits light under the action of current when the driver transistor is saturated.

Optionally in the compensation method according to the embodiment of the disclosure, voltage compensation is performed on the reference voltage signal applied to the corresponding pixel circuit specifically as follows.

The reference voltage signal to which the compensation voltage is added is applied to the pixel circuit, that is, the reference voltage signal received by the pixel circuit corresponding to the compensation voltage lying out of the preset range is a signal obtained after the corresponding compensation voltage is added to the voltage of the original reference voltage signal. Accordingly when the compensation voltage is positive voltage, the voltage of the compensated reference voltage signal is raised, and when the compensation voltage is negative voltage, the voltage of the compensated reference voltage signal is lowered.

Optionally the pre-stored high-voltage signal received by the pixel circuit in the preceding frame is a detected high-voltage signal received at the first electrode of the driver transistor in the pixel circuit in the preceding frame when the light-emitting element in the pixel circuit was emitting light in the preceding frame. In the compensation method according to the embodiment of the disclosure, after the high-voltage signal received at the first electrode of the driver transistor in the pixel circuit in the current frame is detected, and before the compensation voltage corresponding to the pixel circuit is determined, the method can further include the following step.

The detected high-voltage signal received at the first electrode of the driver transistor in the pixel circuit in the current frame is stored.

In the organic light-emitting display panel, an element generating a high-voltage signal is generally a VDD power source. Since the VDD power source is connected respectively with pixel circuits in the organic light-emitting display panel through signal lines, and the signal lines have resistances, there is an IR drop for each of the high-voltage signals received by the pixel circuits.

Figure 2:
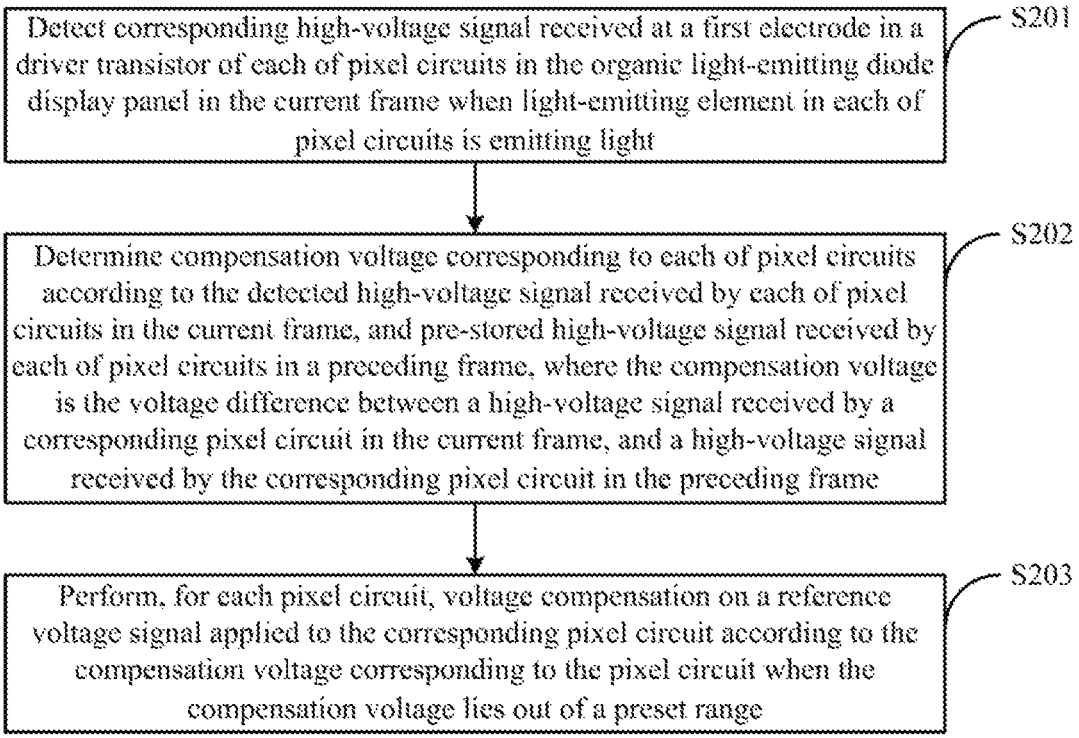
FIG. 2 is a first flow chart of the compensation method according to the embodiment of the disclosure.

Accordingly optionally in the compensation method according to the embodiment of the disclosure, there may be a plurality of pixel circuits in a display area of the organic light-emitting display panel. As illustrated in FIG. 2, the compensation method can specifically include the following steps.

The step S201 is to detect corresponding high-voltage signal received at a first electrode of a driver transistor in each of the pixel circuits in the organic light-emitting diode display panel in the current frame when a light-emitting element in each of the pixel circuits is emitting light.

The step S202 is to determine compensation voltage corresponding to each of the pixel circuits according to the detected high-voltage signal received by each of the pixel circuits in the current frame, and a pre-stored high-voltage signal received by each of the pixel circuits in a preceding frame, where the compensation voltage is the voltage difference between a high-voltage signal received by a corresponding pixel circuit in the current frame, and a high-voltage signal received by the corresponding pixel circuit in the preceding frame.

The step S203 is to perform, for each of the pixel circuits, voltage compensation on a reference voltage signal applied to the corresponding pixel circuit according to the compensation voltage corresponding to the pixel circuit when the compensation voltage lies out of a preset range.

Specifically the reference voltage signal to which the compensation voltage is added is applied to the corresponding pixel circuit.

In the compensation method above according to the embodiment of the disclosure, the high-voltage signal received by the driver transistor of each of the pixel circuits in a display area of the organic light-emitting display panel is detected, and then compensation voltage corresponding to each of the pixel circuits is determined for the pixel circuits, and when the compensation voltage corresponding to a pixel circuit lies out of a preset range, voltage compensation is performed on a reference voltage signal received by the pixel circuit corresponding to the compensation voltage lying out of the preset range. Thus the high-voltage signal received by each of the pixel circuits in the organic light-emitting display panel can be detected, and voltage compensation can be performed only on the reference voltage signal received by the pixel circuit corresponding to the compensation voltage lying out of the preset range, that is, signal compensation can be performed only on the reference voltage signal received by the pixel circuit for which voltage compensation needs to be performed in two adjacent frames of images, instead of the reference voltage signals received by all pixel circuits, to thereby improve the displayed images, and lower power consumption.

In the organic light-emitting display panel, there are generally a smaller IR drop corresponding to a pixel circuit closer to the VDD power source, and a larger IR drop corresponding to a pixel circuit further from the VDD power source, and when there is a varying high-voltage signal of the pixel circuit corresponding to the smaller IR drop in two adjacent frames, there is generally also a less influence on a display effect of the images, and even the influence on the display effect of the images can be neglected.

Accordingly, no voltage compensation may be performed on the pixel circuit with the smaller IR drop to thereby further lower power consumption.

Optionally in the compensation method according to the embodiment of the disclosure, a display area of the organic light-emitting display panel may include a plurality of display sub-areas, and there may be at least one pixel circuit in each display sub-area. Before the high-voltage signal received at the first electrode of the driver transistor in the pixel circuit is detected, the compensation method can further include the following steps.

An IR drop corresponding to each of the display sub-areas is determined.

For each of the display sub-areas, when the IR drop, corresponding to the display sub-area, lies out of a preset drop range, the display sub-area corresponding to the IR drop lying out of the preset drop range is determined as a display sub-area to be compensated.

Detecting the high-voltage signal received at the first electrode of the driver transistor in a pixel circuit in the organic light-emitting diode display panel in the current frame when the light-emitting element in the pixel circuit is emitting light can specifically include the following step.

Detecting the high-voltage signal received at the first electrode of the driver transistor in each of the at least one pixel circuit in the display sub-area to be compensated, in the current frame when the light-emitting element in each of the at least one pixel circuit in the display sub-area to be compensated are emitting light.

Optionally in the compensation method according to the embodiment of the disclosure, the preset drop range is an allowable drop error range which is derived empirically. For example, the preset drop range may be 0V to 0.100V, or 0V to 0.01V, or 0V to 0.001V. Of course, the allowable drop error range above is different as required for the organic light-emitting display panel with a different function, so the preset drop range shall be designed for a real application environment, although the embodiment of the disclosure will not be limited thereto.

Optionally in the compensation method according to the embodiment of the disclosure, there may be one pixel circuit in each display sub-area, or there may be a plurality of pixel circuits, e.g., two, three, four, etc., pixel circuits, in each display sub-area, although the embodiment of the disclosure will not be limited thereto.

Optionally in the compensation method according to the embodiment of the disclosure, the display sub-areas can be of the same area size, or the display sub-areas can be of different area sizes. Of course, alternatively a part of the display sub-areas can be of the same area size, and the remaining display sub-areas can be of different area sizes, although the embodiment of the disclosure will not be limited thereto.

Figure 3:
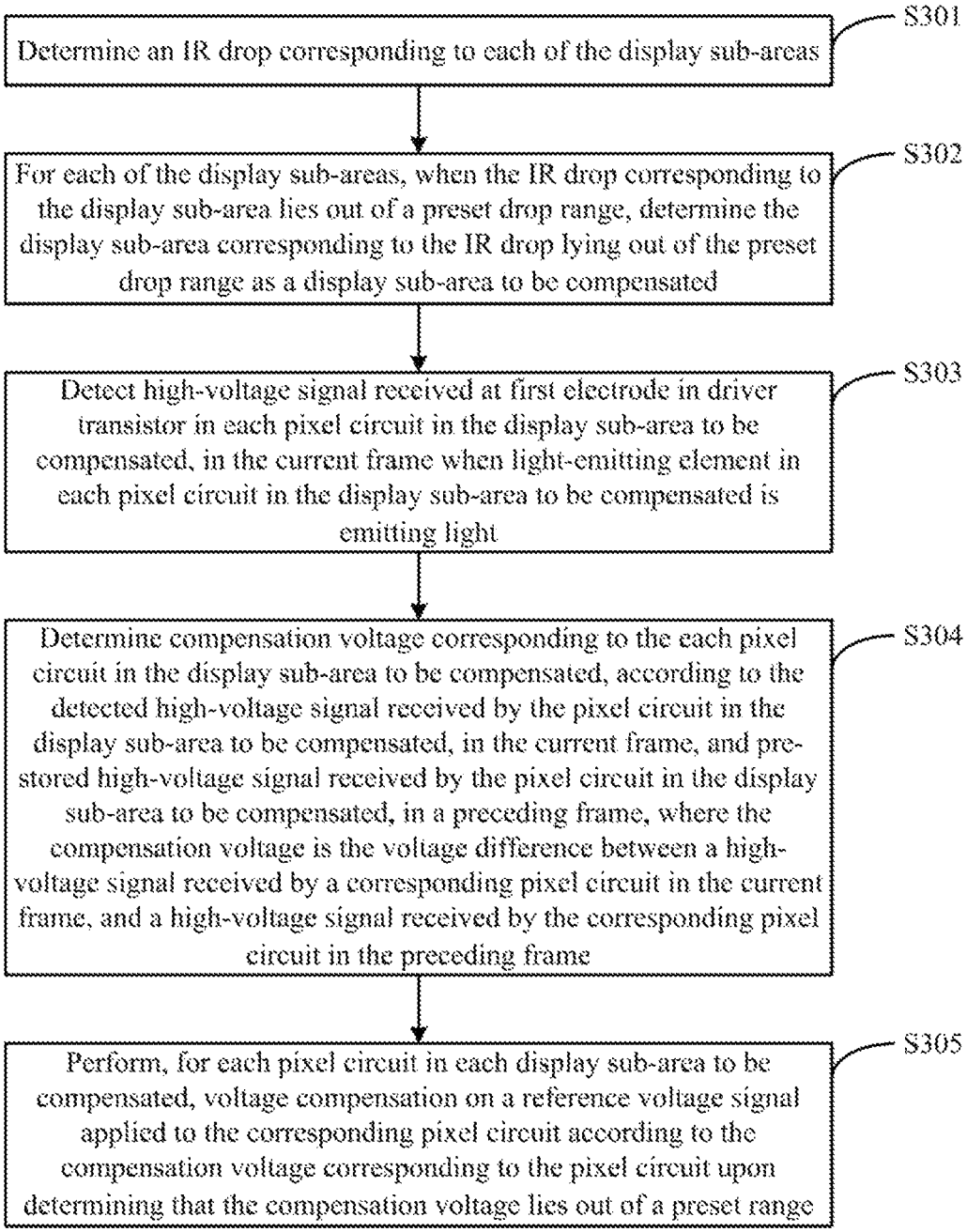
FIG. 3 is a second flow chart of the compensation method according to the embodiment of the disclosure.

Accordingly as illustrated in FIG. 3, the compensation method according to the embodiment of the disclosure can specifically include the following steps.

The step S301 is to determine an IR drop corresponding to each of the display sub-areas.

The step S302 is, for each of the display sub-areas, when the IR drop corresponding to the display sub-area lies out of a preset drop range, to determine the display sub-area, corresponding to the IR drop lying out of the preset drop range, as a display sub-area to be compensated.

The step S303 is to detect a high-voltage signal received at a first electrode of a driver transistor in each of the at least one pixel circuit in the display sub-area to be compensated, in the current frame when the light-emitting element in each of the at least one pixel circuit in the display sub-area to be compensated is emitting light.

The step S304 is to determine compensation voltage corresponding to each of the at least one pixel circuit in the display sub-area to be compensated, according to the detected high-voltage signal received by each pixel circuit in the display sub-area to be compensated, in the current frame, and pre-stored high-voltage signal received by each pixel circuit in the display sub-area to be compensated, in a preceding frame. The compensation voltage is the voltage difference between a high-voltage signal received by a corresponding pixel circuit in the current frame, and a high-voltage signal received by the corresponding pixel circuit in the preceding frame.

The step S305 is to perform, for each pixel circuit in each display sub-area to be compensated, voltage compensation on a reference voltage signal applied to the corresponding pixel circuit according to the compensation voltage corresponding to the pixel circuit upon determining that the compensation voltage lies out of a preset range.

Specifically the reference voltage signal to which the compensation voltage is added is applied to the corresponding pixel circuit.

In the compensation method above according to the embodiment of the disclosure, only the compensation voltage corresponding to the pixel circuit in the display sub-area to be compensated, is determined, and voltage compensation is performed on the reference voltage signal of the pixel circuit corresponding to the compensation voltage lying out of the preset range, thus further lowering power consumption.

Figure 4:
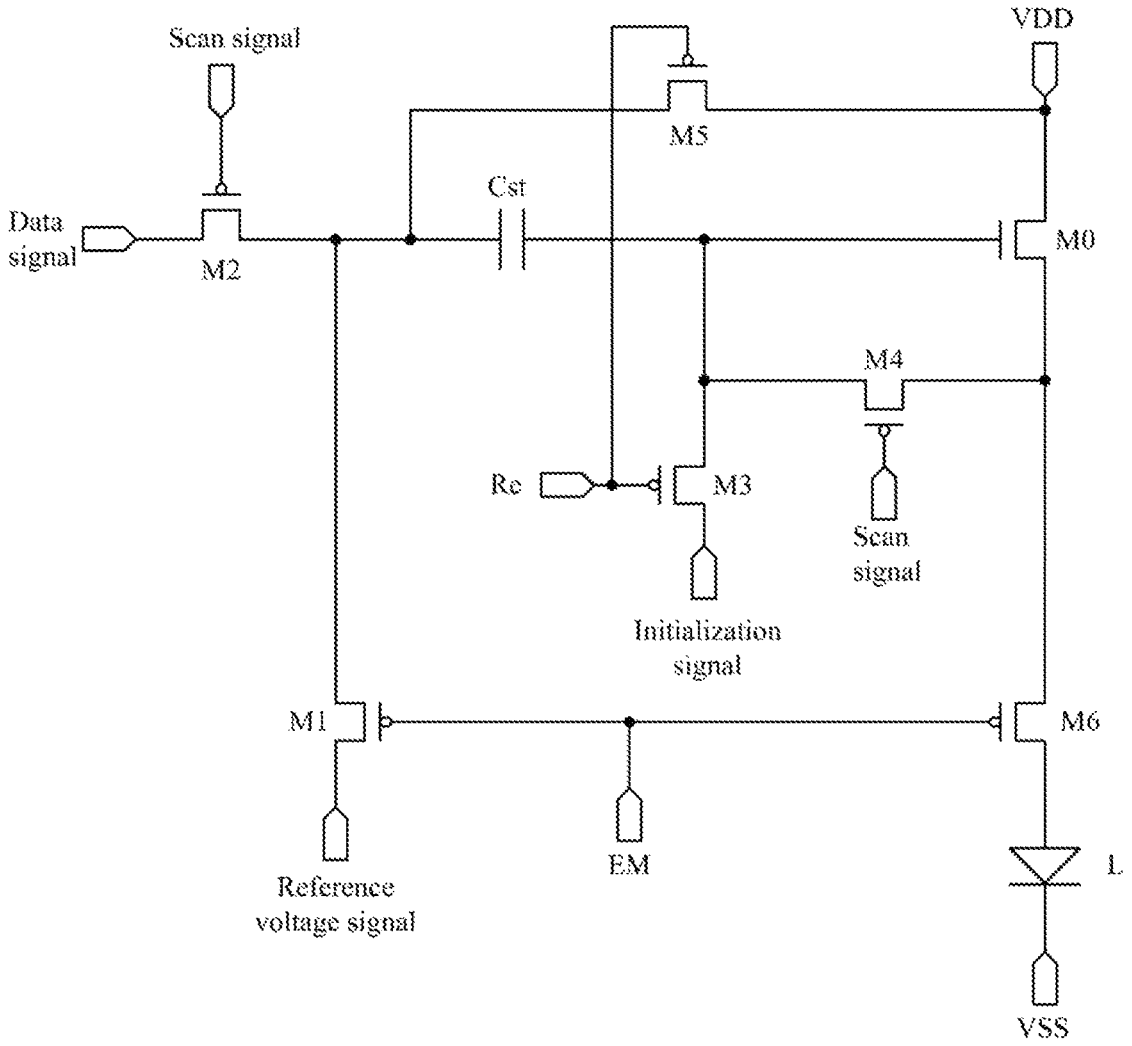
FIG. 4 is a schematic structural diagram of a pixel circuit according to an embodiment of the disclosure.

Specifically the pixel circuit may have various structures. Optionally in the compensation method above according to the embodiment of the disclosure, as illustrated in FIG. 4, the pixel circuit can specifically include: a driver transistor M0, a storage capacitor Cst, a first switch transistor M1, a second switch transistor M2, a third switch transistor M3, a fourth switch transistor M4, a fifth switch transistor M5, and a sixth switch transistor M6.

The driver transistor M0 includes a first electrode configured to receive a high-voltage signal VDD, and a second electrode connected with a first terminal of a light-emitting element L through the sixth switch transistor M6; and a second terminal of the light-emitting element L is configured to receive a low-voltage signal VSS.

The first switch transistor M1 includes a first electrode configured to receive a reference voltage signal Vref, a control electrode configured to receive a light-emission control signal EM, and a second electrode connected with a first terminal of the storage capacitor Cst.

The second switch transistor M2 includes a first electrode configured to receive a data signal Vdata, a control electrode configured to receive a scan signal Scan, and a second electrode connected with the first terminal of the storage capacitor Cst.

The third switch transistor M3 includes a first electrode configured to receive an initialization signal Vinit, a control electrode configured to receive a reset signal Re, and a second electrode connected with the second terminal of the storage capacitor Cst.

The fourth switch transistor M4 includes a control electrode configured to receive the scan signal Scan, a first electrode connected with a control electrode of the driver transistor M0, and a second electrode connected with the second electrode of the driver transistor M0.

The fifth switch transistor M5 includes a first electrode configured to receive the high-voltage signal VDD, a control electrode configured to receive the reset signal Re, and a second electrode connected with the first terminal of storage capacitor Cst.

The sixth switch transistor M6 includes a control electrode configured to receive the light-emission control signal EM, a first electrode connected with the second electrode of the driver transistor M0, and a second electrode connected with the first terminal of the light-emitting element L.

Optionally in the pixel circuit above, the first terminal of the light-emitting element may be an anode, and the second terminal thereof may be a cathode.

Optionally the control electrodes may be gates, the first electrodes may be sources or drains, and the second electrodes may be drains or sources, dependent upon different types of the respective switch transistors above, and different signals input thereto, although the embodiment of the disclosure will not be limited thereto.

The structure of the pixel circuit in the method according to the embodiment of this disclosure has been described above only by way of an example, and in a specific implementation, the specific structure of the pixel circuit will not be limited to the structure above according to the embodiment of this disclosure, and can also be another structure known to those skilled in the art, although the embodiment of the disclosure will not be limited thereto.

Figure 5:
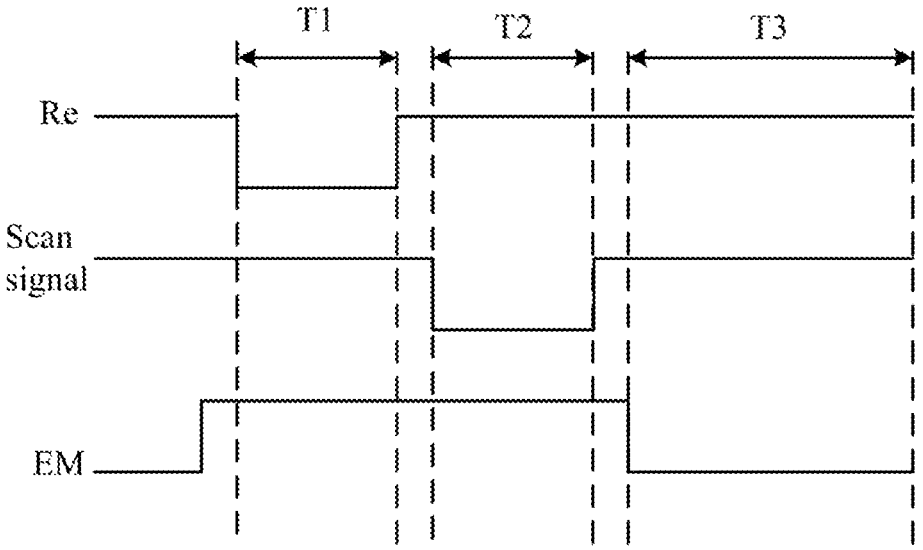
FIG. 5 is a timing diagram of the pixel circuit as illustrated in FIG. 4.

The compensation method according to the embodiment of the disclosure will be described in connection with the structure of the pixel circuit as illustrated in FIG. 4, and the timing diagram of the circuit as illustrated in FIG. 5. There are specifically three phases of an initialization phase T1, a data write phase T2, and a light emission phase T3 in the current frame in the timing diagram of the circuit as illustrated in FIG. 5.

Since each frame of image is only displayed in the light emission phase T3, and there is a short time interval between the preceding frame and the current frame, the high-voltage signal VDD received at the first electrode of the driver transistor M0 before the light emission phase T3 in the current frame may be regarded as the high-voltage signal VDD received at the first electrode of the driver transistor M0 in the preceding frame, that is, the signal received at the first electrode of the driver transistor M0 in the initialization phase T1 and the data write phase T2 in the current frame is the high-voltage signal VDD at voltage $V_{dd(1)}$ in the preceding frame, and the signal received at the first electrode of the driver transistor M0 in the light emission phase T3 in the current frame is the high-voltage signal VDD at voltage $V_{dd(2)}$ in the current frame.

In the initialization phase T1, the reset signal Re at a low level controls the third switch transistor M3 and the fifth switch transistor M5 to be turned on. The third switch transistor M3 which is turned on provides the initialization signal Vinit for the second terminal of the storage capacitor Cst and the control electrode of the driver transistor M0, to initialize voltage of the storage capacitor Cst and the control electrode of the driver transistor M0. The fifth switch transistor M5 which is turned on provides the first terminal of the storage capacitor Cst with the high-voltage signal VDD at the voltage $V_{dd(1)}$.

In the data write phase T2, the scan signal Scan at a low level controls the second switch transistor M2 and the fourth switch transistor M4 to be turned on. The second switch transistor M2 which is turned on provides the first terminal of the storage capacitor Cst with the data signal Vdata, so that voltage at the first terminal of the storage capacitor Cst is voltage $V_{data}$ of the data signal Vdata. The fourth switch transistor M4 is turned on so that the control electrode of the driver transistor M0 is communicated with the second electrode thereof to form a connected diode, so that the storage capacitor Cst is charged with the high-voltage signal VDD at the voltage $V_{dd(1)}$ through the driver transistor M0 until voltage at the control electrode of the driver transistor M0 becomes $V_{dd(1)}+V_{th}$, where $V_{th}$ is threshold voltage of the driver transistor M0.

In the light-emission phase T3, the light-emission control signal EM at a low level controls the first switch transistor M1 and the sixth switch transistor M6 to be turned on. The first switch transistor M1 which is turned on provides the first terminal of the storage capacitor Cst with the reference voltage signal Vref at original $V_{ref(0)}$, so that the voltage at the first terminal of the storage capacitor Cst is $V_{ref(0)}$. Since the control electrode of the driver transistor M0 is floating, voltage at the second terminal of the storage capacitor Cst jumps to $V_{dd(1)}+V_{th}-V_{data}+V_{ref(0)}$ due to the coupling of the storage capacitor Cst. At this time, the driver transistor M0 is turned on to drive the light-emitting element L to emit light. At this time, the high-voltage signal VDD received at the first electrode of the driver transistor M0 is detected as the high-voltage signal VDD at the voltage $V_{dd(2)}$ received by the driver transistor M0 in the current frame, that is, at this time, the voltage at the first electrode of the driver transistor M0 is $V_{dd(2)}$. Compensation voltage $\Delta V_{dd}$ corresponding to the pixel circuit is determined according to the high-voltage signal VDD at the voltage $V_{dd(2)}$ in the current frame, and the pre-stored high-voltage signal VDD at the voltage $V_{dd(2)}$ in the preceding frame, that is, $\Delta V_{dd}=V_{dd(2)}-V_{dd(1)}$. Upon determining that $\Delta V_{dd}$ lies out of the preset range, $V_{ref(0)}+\Delta V_{dd}$ is applied to the first electrode of the first switch transistor M1, so that the voltage at the first terminal of the storage capacitor Cst becomes $V_{ref(0)}+\Delta V_{dd}$, and the voltage at the second terminal of the storage capacitor Cst jumps to $V_{dd(1)}+V_{th}-V_{data}+V_{ref(0)}+\Delta V_{dd}$. Since voltage at the source of the driver transistor M0 is $V_{dd(2)}$, voltage at the gate thereof is $V_{dd(1)}+V_{th}-V_{data}+V_{ref(0)}+\Delta V_{dd}$. As per the current characteristic of the saturated driver transistor M0, current $I_L$ flowing through the driver transistor M0 satisfies the equation of $I_L=K[V_{dd(1)}+V_{th}-V_{data}+V_{ref(0)}+\Delta V_{dd}-V_{dd(2)}-V_{th}]^2$, and since $\Delta V_{dd}=V_{dd(2)}-V_{dd(1)}$, $I_L=K[V_{ref(0)}-V_{data}]^2$. Accordingly voltage compensation can be performed on the reference voltage signal applied to the pixel circuit to thereby avoid the problem that when two adjacent frames of images are different, there is different high-voltage signal VDD received at the first electrode of the driver transistor M0, thus resulting in crosstalk between the images while a finger of a user is touching on and sliding over the images, and deteriorating a display effect of the images.

Furthermore in the light-emission phase T3, it takes a very short period of time to detect the high-voltage signal received by the pixel circuit, and to perform voltage compensation on the reference voltage signal applied to the pixel circuit, so there is such a less influence on the light-emitting element L emitting light in the light-emission phase T3 that can be neglected.

Of course, upon determining that $\Delta V_{dd}$ lies into the preset range, the reference voltage signal applied to the pixel circuit remains original reference voltage signal, that is, no voltage compensation is performed.

Figure 6:
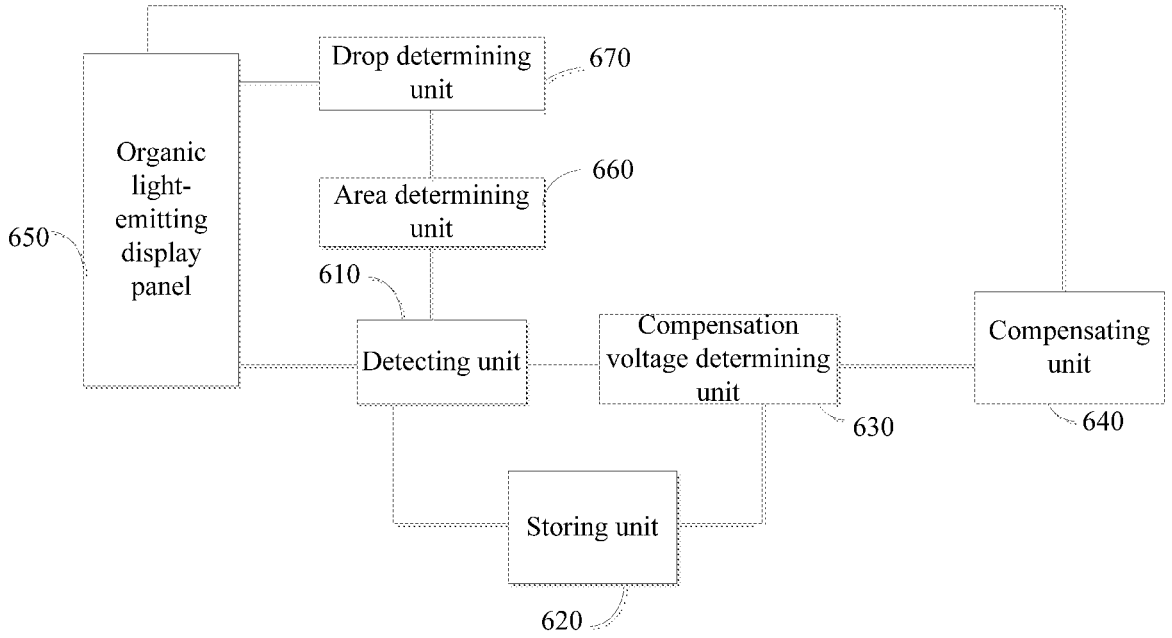
FIG. 6 is a schematic structural diagram of a compensation device of an organic light-emitting diode display panel according to an embodiment of the disclosure.

Based upon the same inventive idea, an embodiment of the disclosure further provides a compensation device of an organic light-emitting diode display panel, and as illustrated in FIG. 6, the device includes the following units.

A detecting unit 610 is configured to detect a high-voltage signal received at a first electrode of a driver transistor in a pixel circuit in the organic light-emitting diode display panel 650 in the current frame when a light-emitting element in the pixel circuit is emitting light.

A storing unit 620 is configured to store a detected high-voltage signal received at the first electrode of the driver transistor in the pixel circuit in a preceding frame.

A compensation voltage determining unit 630 is configured to determine compensation voltage corresponding to the pixel circuit according to the detected high-voltage signal received by the pixel circuit in the current frame, and the pre-stored high-voltage signal received by the pixel circuit in the preceding frame. The compensation voltage is the voltage difference between the high-voltage signal received in the current frame, and the high-voltage signal received in the preceding frame.

A compensating unit 640 is configured to perform voltage compensation on a reference voltage signal applied to the corresponding pixel circuit according to the compensation voltage when the compensation voltage lies out of a preset range.

The compensation device above of an organic light-emitting diode display panel according to the embodiment of the disclosure includes a detecting unit, a storing unit, a compensation voltage determining unit, and a compensating unit. The detecting unit is configured to detect a high-voltage signal received at a first electrode of a driver transistor in a pixel circuit in the organic light-emitting diode display panel in the current frame when a light-emitting element in the pixel circuit is emitting light; the storing unit is configured to store a detected high-voltage signal received at the first electrode of the driver transistor in the pixel circuit in a preceding frame; the compensation voltage determining unit is configured to determine compensation voltage corresponding to the pixel circuit according to the detected high-voltage signal received by the pixel circuit in the current frame, and the pre-stored high-voltage signal received by the pixel circuit in the preceding frame, where the compensation voltage is the voltage difference between the high-voltage signal received in the current frame, and the high-voltage signal received in the preceding frame; and the compensating unit is configured to perform voltage compensation on a reference voltage signal applied to the corresponding pixel circuit according to the compensation voltage when the compensation voltage lies out of a preset range. The units above can cooperate with each other to thereby alleviate the problem of crosstalk between moving images when a user is touching on the images so as to improve the display effect of the images.

The compensation device above of an organic light-emitting diode display panel according to the embodiment of the disclosure can be a chip including software and hardware in combination, or can be a product in an all-hardware form, or can be in an all-software form. Furthermore the embodiment of the disclosure can be in the form of a computer program product implemented on a computer readable storage medium (including but not limited to a magnetic memory, an optical memory, etc.) including computer useable program codes.

In a real application, even if two adjacent frames of displayed images are the same, then the high-voltage signal received at the first electrode of the driver transistor generally cannot remain exactly uniform due to a process, aging of components, etc., thereof, so when the difference between the high-voltage signals received at the first electrode of the driver transistor in the two adjacent frames lies into an allowable error range, they can be regarded as being substantially equal. Optionally in the compensation device according to the embodiment of the disclosure, the preset range is an allowable error range which is derived empirically. For example, the preset range can be −0.100V to 0.100V, or −0.01V to 0.01V, or −0.001V to 0.001V. Of course, the allowable error range above is different as required for the organic light-emitting display panel with a different function, so the preset range shall be designed for a real application environment, although the embodiment of the disclosure will not be limited thereto.

Optionally in the compensation device according to the embodiment of the disclosure, there are a plurality of pixel circuits in a display area of the organic light-emitting display panel 650.

The detecting unit 610 is configured to detect corresponding high-voltage signal received at the first electrode of the driver transistor in each of the plurality of pixel circuits in the organic light-emitting diode display panel in the current frame when the light-emitting element in each of the pixel circuits is emitting light.

The compensation voltage determining unit 630 is configured to determine compensation voltage corresponding to each of the pixel circuits according to the detected high-voltage signal received by each of the pixel circuits in the current frame, and pre-stored high-voltage signal received by each of the pixel circuits in a preceding frame, where the compensation voltage is the voltage difference between a high-voltage signal received by a corresponding pixel circuit in the current frame, and a high-voltage signal received by the corresponding pixel circuit in the preceding frame.

The compensating unit 640 is configured to perform, for each pixel circuit, voltage compensation on a reference voltage signal applied to the corresponding pixel circuit according to the compensation voltage corresponding to the pixel circuit when the compensation voltage lies out of a preset range.

Optionally in the compensation device according to the embodiment of the disclosure, a display area of the organic light-emitting display panel includes a plurality of display sub-areas, and there is at least one pixel circuit in each display sub-area.

The compensation device further includes the following units.

A drop determining unit 670 is configured to determine an IR drop corresponding to each of the display sub-areas.

An area determining unit 660 is configured, for each display sub-area, when the IR drop corresponding to the display sub-area lies out of a preset drop range, to determine the display sub-area corresponding to the IR drop lying out of the preset drop range as a display sub-area to be compensated.

The detecting unit is configured to detect the high-voltage signal received at first electrode of the driver transistor in each of the at least one pixel circuit in the display sub-area to be compensated, in the current frame when the light-emitting element in each of the at least one pixel circuit in the display sub-area to be compensated is emitting light.

The compensation voltage determining unit is configured to determine compensation voltage corresponding to each pixel circuit in the display sub-area to be compensated, according to the detected high-voltage signal received by each pixel circuit in the display sub-area to be compensated, in the current frame, and pre-stored high-voltage signal received by each pixel circuit in the display sub-area to be compensated, in a preceding frame, where the compensation voltage is the voltage difference between a high-voltage signal received by a corresponding pixel circuit in the current frame, and a high-voltage signal received by the corresponding pixel circuit in the preceding frame.

The compensating unit is configured to perform, for each pixel circuit in each display sub-area to be compensated, voltage compensation on a reference voltage signal applied to the corresponding pixel circuit according to the compensation voltage corresponding to the pixel circuit upon determining that the compensation voltage lies out of a preset range.

Optionally in the compensation device according to the embodiment of the disclosure, there may be one pixel circuit in each display sub-area, or there may be a plurality of pixel circuits, e.g., two, three, four, etc., pixel circuits, in each display sub-area, although the embodiment of the disclosure will not be limited thereto.

Optionally in the compensation device according to the embodiment of the disclosure, the display sub-areas can be of the same area size, or the display sub-areas can be of different area sizes. Of course, alternatively a part of the display sub-areas can be of the same area size, and the remaining display sub-areas can be of different area sizes, although the embodiment of the disclosure will not be limited thereto.

Optionally in the compensation device according to the embodiment of the disclosure, the compensating unit is configured to apply the reference voltage signal, to which the compensation voltage is added, to the corresponding pixel circuit.

Optionally in the compensation device according to the embodiment of the disclosure, the storing unit is further configured to store the detected high-voltage signal received at the first electrode of the driver transistor in the pixel circuit in the current frame.

Based upon the same inventive idea, an embodiment of the disclosure further provides an organic light-emitting display device. The organic light-emitting display device includes an organic light-emitting display panel. The organic light-emitting display panel includes a plurality of pixel circuits arranged in an array, and the compensation device according to any one of the embodiments above of the disclosure. The organic light-emitting display device addresses the problem under a similar principle to the compensation device above, so reference can be made to the implementation of the compensation device above for an implementation of the organic light-emitting display device, and a repeated description thereof will be omitted here.

Optionally the pixel circuits in the organic light-emitting display device above according to the embodiment of the disclosure are structured as illustrated in FIG. 4, and a repeated description thereof will be omitted here. Of course, the pixel circuits can alternatively be structured otherwise, although the embodiment of the disclosure will not be limited thereto.

Optionally the organic light-emitting display device above according to the embodiment of the disclosure can be a mobile phone, a tablet computer, a TV set, a monitor, a notebook computer, a digital photo frame, a navigator, or any other product or component with a display function. All the other components indispensable to the organic light-emitting display device shall readily occur to those ordinarily skilled in the art, and a repeated description thereof will be omitted here, although the embodiment of the disclosure will not be limited thereto.

In the compensation method above of an organic light-emitting diode display panel according to the embodiment of the disclosure, a high-voltage signal received at a first electrode of a driver transistor in the pixel circuit is detected when a light-emitting element in the pixel circuit is emitting light in the current frame, where the high-voltage signal is a signal used by the driver transistor to generate current in the current frame to drive the light-emitting element connected therewith to emit light; and then the voltage difference between the high-voltage signal received by the pixel circuit in the current frame, and a high-voltage signal received by the pixel circuit in a preceding frame, i.e., compensation voltage, is determined according to the detected high-voltage signal received by the pixel circuit in the current frame, and the pre-stored high-voltage signal received by the pixel circuit in the preceding frame, and voltage compensation is performed on a reference voltage signal applied to the pixel circuit according to the compensation voltage when the compensation voltage lies out of a preset range, so that the problem of crosstalk between moving images when a user is touching on the images can be alleviated to thereby improve a display effect of the images.

Those skilled in the art shall appreciate that the embodiments of the disclosure can be embodied as a method, a system or a computer program product. Therefore the disclosure can be embodied in the form of an all-hardware embodiment, an all-software embodiment or an embodiment of software and hardware in combination. Furthermore the disclosure can be embodied in the form of a computer program product embodied in one or more computer useable storage mediums (including but not limited to a disk memory, a CD-ROM, an optical memory, etc.) in which computer useable program codes are contained.

The disclosure has been described in a flow chart and/or a block diagram of the method, the device (system) and the computer program product according to the embodiments of the disclosure. It shall be appreciated that respective flows and/or blocks in the flow chart and/or the block diagram and combinations of the flows and/or the blocks in the flow chart and/or the block diagram can be embodied in computer program instructions. These computer program instructions can be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow chart and/or the block(s) of the block diagram.

These computer program instructions can also be stored into a computer readable memory capable of directing the computer or the other programmable data processing device to operate in a specific manner so that the instructions stored in the computer readable memory create an article of manufacture including instruction means which perform the functions specified in the flow(s) of the flow chart and/or the block(s) of the block diagram.

These computer program instructions can also be loaded onto the computer or the other programmable data processing device so that a series of operational steps are performed on the computer or the other programmable data processing device to create a computer implemented process so that the instructions executed on the computer or the other programmable device provide steps for performing the functions specified in the flow(s) of the flow chart and/or the block(s) of the block diagram.

Although the preferred embodiments of the disclosure have been described, those skilled in the art benefiting from the underlying inventive concept can make additional modifications and variations to these embodiments. Therefore the appended claims are intended to be construed as encompassing the preferred embodiments and all the modifications and variations coming into the scope of the disclosure.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A compensation method of an organic light-emitting diode display panel, comprising:

detecting a high-voltage signal received at a first electrode of a driver transistor in at least one pixel circuit in the organic light-emitting diode display panel in a current frame when a light-emitting element in the at least one pixel circuit is emitting light;

determining compensation voltage corresponding to the at least one pixel circuit according to the detected high-voltage signal received by the at least one pixel circuit in the current frame, and a pre-stored high-voltage signal received by the at least one pixel circuit in a preceding frame, wherein the compensation voltage is the voltage difference between the high-voltage signal received in the current frame, and the high-voltage signal received in the preceding frame; and performing voltage compensation on a reference voltage signal applied to the corresponding pixel circuit according to the compensation voltage when the compensation voltage lies out of a preset range;

wherein the performing voltage compensation on the reference voltage signal applied to the corresponding pixel circuit according to the compensation voltage comprises:

applying the reference voltage signal, to which the compensation voltage is added, to the corresponding pixel circuit.

2. The compensation method according to claim 1, wherein a display area of the organic light-emitting display panel comprises a plurality of display sub-areas, and each of the display sub-areas comprises the at least one pixel circuit; and before the high-voltage signal received at the first electrode of the driver transistor in the at least one pixel circuit in the current frame is detected, the method further comprises:

determining an IR drop corresponding to each of the display sub-areas, and for each of the display sub-areas, when the IR drop corresponding to the display sub-area lies out of a preset drop range, determining the display sub-area corresponding to the IR drop lying out of the preset drop range as a display sub-area to be compensated; and the detecting the high-voltage signal received at the first electrode of the driver transistor in the at least one pixel circuit in the organic light-emitting diode display panel in the current frame when the light-emitting element in the pixel circuit is emitting light comprises:

detecting the high-voltage signal received at the first electrode of the driver transistor in each of the at least one pixel circuit in the display sub-area to be compensated, in the current frame when the light-emitting element in each of the at least one pixel circuit in the display sub-area to be compensated is emitting light.

3. The compensation method according to claim 2, wherein the plurality of display sub-areas are of the same area size.

4. The compensation method according to claim 1, wherein after the high-voltage signal received at the first electrode of the driver transistor in the at least one pixel circuit in the current frame is detected, and before the compensation voltage corresponding to the at least one pixel circuit is determined, the method further comprises:

storing the detected high-voltage signal received at the first electrode of the driver transistor in the at least one pixel circuit in the current frame.

* * * * *